United States Patent [19]

Lee et al.

[11] 4,282,295

[45] Aug. 4, 1981

[54] ELEMENT FOR THERMOPLASTIC RECORDING

[75] Inventors: Tzuo-Chang Lee; Jacob W. Lin, both of Bloomington, Minn.

[73] Assignee: Honeywell Inc., Minneapolis, Minn.

[21] Appl. No.: 64,271

[22] Filed: Aug. 6, 1979

[51] Int. Cl.[3] ..... G03C 16/00

[52] U.S. Cl. ..... 430/2; 346/77 E; 346/135.1; 346/151; 358/2; 428/333; 428/336; 428/433; 428/458; 428/688; 428/913; 428/918; 430/50

[58] Field of Search ..... 430/1, 2, 50; 346/135.1, 151, 77 E; 428/333, 336; 350/3.63, 3.61, 3.6; 358/2, 129; 365/216

[56] References Cited

U.S. PATENT DOCUMENTS

| | | | |
|---|---|---|---|
| 3,445,281 | 5/1969 | Sullivan | 428/333 |
| 3,819,369 | 6/1974 | Trubisky | 430/50 |
| 4,012,253 | 3/1977 | Gange | 430/2 |
| 4,131,462 | 12/1978 | Lee et al. | 430/2 |
| 4,163,667 | 8/1979 | Wysocki | 430/50 |

*Primary Examiner*—Stanley S. Silverman
*Attorney, Agent, or Firm*—Omund R. Dahle

[57] ABSTRACT

In a thermoplastic-photoconductor holographic recording medium in the form of several transparent layers over a transparent substrate, such as an optically transparent electrically conductive layer, then a photoconductor layer and a thermoplastic layer over such as glass or Mylar, a conventional material such as gold or platinum has been used as a transparent conductive layer. It is desired to use a less precious metal such as nickel-chromium (NiCr) as the conductive layer, however a limitation has been found in that an unwanted dark charge injection occurs from the NiCr to the photoconductive layer. This causes poor charge acceptance and therefore results in poor halogram formation. Herein a mono atom thick layer of the NiCr is treated and becomes on oxide layer which forms an effective charge blocking layer to dark charge injection.

6 Claims, 4 Drawing Figures

ELEMENT FOR THERMOPLASTIC RECORDING

BACKGROUND AND SUMMARY OF THE INVENTION

Thermoplastic-photoconductor holographic recording medium has generally been in the form of several transparent layers over a transparent substrate. Thus a substrate such as nesa glass or a flexible substrate such as Mylar is first coated thereon an optically transparent electrically conductive layer, then a photoconductor layer, and finally a thermoplastic layer.

In prior U.S. Pat. No. 4,131,462, assigned to the same assignee as the present invention, an optically transparent electrically conductive layer is described as a thin film of metal such as gold or indium-tin oxide, the photoconductive layer is described as polyvinyl carbazole (PVK) doped with trinitrofluorenone (TNF) and the top layer is described as a thermoplastic such as resin or synthetic polymers. The transparent conductor layer beneath the thermoplastic-photoconductor medium can also be a number of other materials such as platinum, aluminum, and nickel-chromium (NiCr). NiCr used as the conductor layer has advantages both of low cost and of low reflectivity at the PVK-NiCr interface. This low reflectivity of the NiCr is beneficial to hologram recording and the lower cost is attractive. NiCr presents problems, however, in that when electrostatic charges are applied across the capacitor formed by the free surface and the NiCr electrode, electrons tend to be injected into the PVK causing poor charge acceptance and therefore resulting in poor or no hologram formation. Ideally, the interface between the photoconductor layer and the conductive layer should be a perfect blocking contact (no dark charge injection from NiCr into the photoconductive layer) so that a desirable field ratio (close to 1) between the photoconductor and thermoplastic layers can be maintained. Thus, the charge contrast created during exposure can be retained, resulting in high diffraction efficiency holograms. In reality, however, the NiCr conductive layer departs from the desirable characteristics in that there tends to be an injection of charge into the photoconductive layer. Measurements show the photoconductor layer loses the electric field as the device is charging which results in loss of the field and in loss of charge contrast during and after it is exposed. Thus, the resulting diffraction efficiency of the hologram is weak or none at all. That is to say the NiCr-PVK interface forms a poor blocking contact. This is a problem which does not exist when the more expensive gold is used as the conduction layer.

The present invention is directed to treating the NiCr surface with chemically active species of oxygen such as free radical oxygen, ionized oxygen or atomic state oxygen. This can be carried out in an oxygen plasma environment, for example. In so treating the NiCr surface a mono atom thick layer of the surface of NiCr becomes an oxide layer which is an effective charge blocking layer. After the treatment, the thermoplastic-photoconductor device shows improved performance in terms of cycle-to-cycle repeatability and diffraction efficiency. The problem of charge leakage at the PVK-electrode interface is not unique to NiCr. It occurs also to a lesser extent with indium-tin oxide and it can be corrected by the same technique.

DETAILED DESCRIPTION

Figure 1:
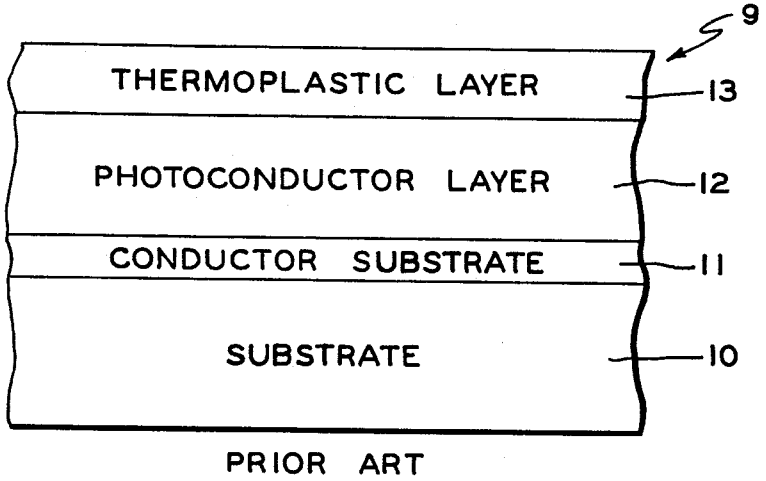
FIGS. 1 and 1*a* are sectional views of prior art thermoplastic-thermoconductive holographic recording medium construction.

The prior art thermoplastic-photoconductive holographic recording medium 9, such as is shown in FIG. 1, has a transparent conductive substrate 11, usually a thin film of metal such as gold, over a transparent base 10 such as nesa glass or a flexible Mylar tape. Coating the conductive substrate is a photoconductive layer 12 and then a thermoplastic layer 13. Recording on thermoplastic-photoconductive holographic recording medium is described in such articles as "An Experimental Read-Write Holographic Memory", by Stewart, Mezrich, Cosentins, Nagle, Wendt, and Lahmar, RCA Review, 34, 3 (March, 1973), and T. C. Lee, "Holographic Recording on Thermoplastic Films", Appl. Optics 13, 888 (1974). The recording process includes the steps of electrically charging the medium, exposing the medium with the information to be stored, recharging the heating to allow the thermoplastic to deform.

Figure 1A:
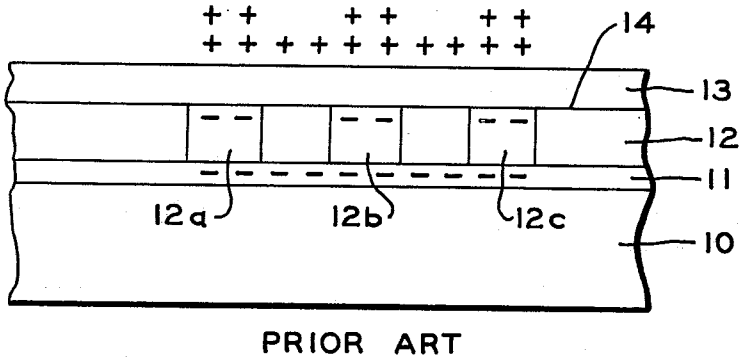

In operation, i.e. in recording on the holographic recording medium, when the photoconductive layer 12 is selectively illuminated by a projected light pattern, the illuminated photoconductor sections 12*a*, 12*b*, and 12*c*, in FIG. 1*a*, become conductive allowing electrical charges to move adjacent the photoconductor-thermoplastic interface 14. A limitation in the use of NiCr as the conductive layer has been found in that when the thermoplastic-photoconductor medium is coated over an electrode such as NiCr it suffers the problem of charge leakage at the photoconductor-NiCr interface, affecting the recording performance adversely.

Figure 2:
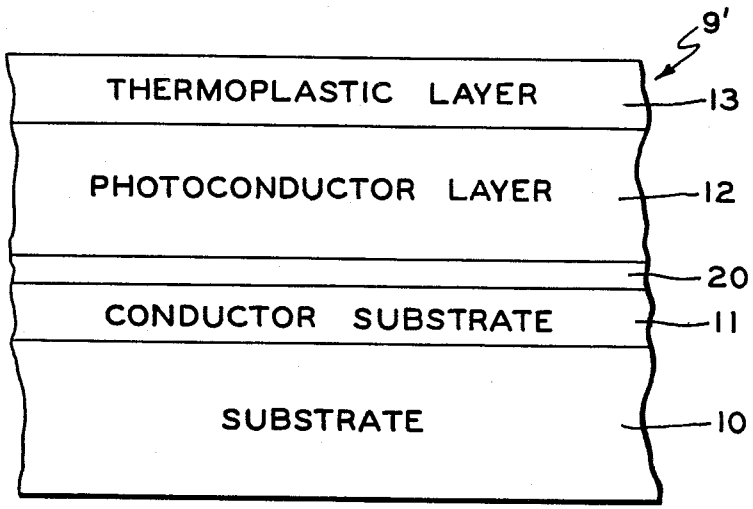
FIGS. 2 and 2*a* are sectional views of an improved thermoplastic-photoconductive holographic recording medium construction according to the invention.
Figure 2A:
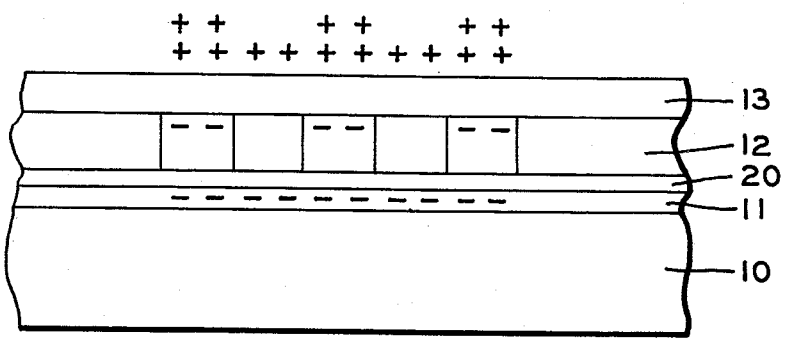

In the present invention shown in FIGS. 2 and 2*a*, the process of preparing the medium is changed from that of the prior art to introduce a new extremely thin additional layer 20 at the interface of the conductive layer 11 and the photoconductive layer 12. In FIGS. 2 and 2*a* the thickness of layer 20 is greatly exaggerated for drawing clarity purposes. This new layer 20 is an oxide layer on the surface of the NiCr conductive layer and is provided by treating the NiCr surface with a chemically active specie of oxygen such as a free radical oxygen, an ionized oxygen or an atomic state oxygen. This preparation of the new layer 20 can be carried out in an oxygen plasma environment, for example. The oxidized layer has to be extremely thin so that the charge can be annihilated at the higher erasing temperature while still providing an effective charge blocking layer against dark charge injection previously described. More specifically, the metal NiCr layer 11 is only about 50–80 Å (Angstroms) thick and the new oxide layer 20 should be a mono-layer (i.e. the first layer of atoms) about 1–10 Å (Angstroms) thick. The resultant oxidized NiCr layer is an effective charge blocking layer. With the addition of this layer the thermoplastic-photoconductive device shows improved performance in terms of cycle-to-cycle repeatability and diffraction efficiency.

It is to be understood that the conductive layer must be thin enough to be transparent at the operating wavelength and thus a NiCr layer of about 50–80 Å has been indicated. When the material indium-tin oxide is used as the conductive layer, it is substantially thicker than the dimensions indicated for NiCr because this material is naturally transparent at the operating wavelength. It also has to be thicker to provide sufficient conductivity to operate as the conductive layer. Such a layer of indium oxide might be, for example, on the order of 0.3 microns thick. The treating of the surface of indium-tin oxide means to fill the lattice vacancies to make the surface a fully oxidized mono layer. This fully oxidized mono layer 20 would be of approximately the same thickness as that described in connection with NiCr.

The embodiments of the invention in which an exclusive property or right is claimed are defined as follows:

1. A thermoplastic-photoconductive holographic recording medium comprising:

an electrically conductive thin nickel-chromium (NiCr) layer thin enough to be transparent at the operating wavelength coated on a substrate;

an extremely thin oxide layer relative to the NiCr layer such as a mono layer over said NiCr layer wherein the thickness of the oxide mono layer is about 1–10 A°;

a photoconductive layer on the oxide mono-layer; and, a thermoplastic layer coated over said photoconductive layer.

2. The thermoplastic-photoconductive holographic recording medium according to claim 1 wherein the thickness of said nickel-chromium layer is about 50–80 Å°.

3. A thermoplastic-photoconductive holographic recording medium comprising:

an electrically conductive indium-tin oxide layer coated on a substrate;

an extremely thin fully oxidized layer relative to the indium-tin oxide layer, such as an oxide mono-layer, over said indium-tin oxide layer wherein the thickness of the fully oxidized mono-layer is about 1–10 A°;

a photoconductive layer on the oxide mono-layer, and;

a thermoplastic layer coated over said photoconductive layer.

4. The thermoplastic-photoconductive holographic recording medium according to claim 3 wherein the thickness of the electrically conductive layer is about 0.3 microns.

5. The thermoplastic-photoconductive holographic recording medium according to claim 1 or 3 wherein the substrate is glass.

6. The thermoplastic-photoconductive holographic recording medium according to claim 1 or 3 wherein the substrate is Mylar.

* * * * *